US006446407B1

(12) United States Patent
Lehane et al.

(10) Patent No.: US 6,446,407 B1
(45) Date of Patent: Sep. 10, 2002

(54) GRID TEE WITH INTEGRALLY STITCHED WEB

(75) Inventors: James J. Lehane, Columbia Station; Douglas B. Hooper, Westlake, both of OH (US)

(73) Assignee: USG Interiors, Inc., Chicago, IL (US)

( * ) Notice: Subject to any disclaimer, the term of this patent is extended or adjusted under 35 U.S.C. 154(b) by 0 days.

(21) Appl. No.: 09/457,784

(22) Filed: Dec. 9, 1999

Related U.S. Application Data

(62) Division of application No. 09/034,497, filed on Mar. 4, 1998, now Pat. No. 6,047,511.

(51) Int. Cl.[7] ..... E04B 2/00; E04B 5/00; E04B 9/00

(52) U.S. Cl. ..... 52/506.07; 52/667; 52/666; 52/665; 52/484; 52/506.06; 403/347; 29/897.35; 29/897.3; 29/21.1; 29/432.2; 172/186

(58) Field of Search ..... 52/506.07, 667, 52/666, 665, 484, 506.06; 403/347; 29/897.35, 897.3, 21.1, 432.2; 172/186

(56) References Cited

U.S. PATENT DOCUMENTS

| | | | | |
|---|---|---|---|---|
| 518,767 A | | 4/1894 | Plecker | |
| 2,663,072 A | | 12/1953 | Pfistershammer | |
| 2,912,075 A | | 11/1959 | Pfistershammer | |
| 3,284,873 A | * | 11/1966 | Noel | 29/21.1 |
| 3,286,314 A | | 11/1966 | Oetiker | |
| 3,726,000 A | | 4/1973 | Hafner | 29/21.1 |
| 3,824,757 A | | 7/1974 | Coop | |
| 3,934,327 A | | 1/1976 | Hafner | |
| 4,489,529 A | | 12/1984 | Ollinger et al. | 52/506.07 X |
| 4,531,279 A | | 7/1985 | Gunter | |
| 4,712,350 A | | 12/1987 | Vukmanic | 52/484 |
| 4,817,357 A | | 4/1989 | Hocevar | 52/732 |
| 4,831,711 A | | 5/1989 | Rapp | 29/509 |
| 4,897,912 A | | 2/1990 | Slasinski | 29/521 X |
| 4,989,387 A | | 2/1991 | Vukmanic et al. | |
| 5,044,138 A | | 9/1991 | Zaccardelli et al. | 52/506.07 X |
| 5,517,743 A | | 5/1996 | Liebig et al. | |
| 5,577,313 A | | 11/1996 | Guido et al. | 29/521 X |
| 5,621,961 A | | 4/1997 | Schleicher | 29/509 |
| 5,678,946 A | | 10/1997 | Inami | |
| 5,839,246 A | | 11/1998 | Zeigler et al. | 52/506.07 |
| 5,979,055 A | * | 11/1999 | Sauer et al. | 29/897.35 |

FOREIGN PATENT DOCUMENTS

| | | | |
|---|---|---|---|
| DE | 44 00 185 | 7/1994 | B21D/39/03 |
| DE | 44 32 639 | 3/1996 | B21D/39/03 |
| GB | 2274080 | 7/1994 | |

* cited by examiner

*Primary Examiner*—Lanna Mai
*Assistant Examiner*—Chi Q Nguyen
(74) *Attorney, Agent, or Firm*—Pearne & Gordon LLP

(57) ABSTRACT

A grid tee of the double web type in which the elements of the web are integrally stitched together to prevent their separation. The stitches are created in an inexpensive rolling process that does not require control of the position of the stitches relative to the ends or other parts of the tee. According to the invention, after the stitches are formed and locked, they are flattened back into the plane of the web to a limited degree where they do not substantially increase the thickness of the web so that they do not interfere with subsequent manufacturing steps or with field assembly.

2 Claims, 2 Drawing Sheets

Fig.3
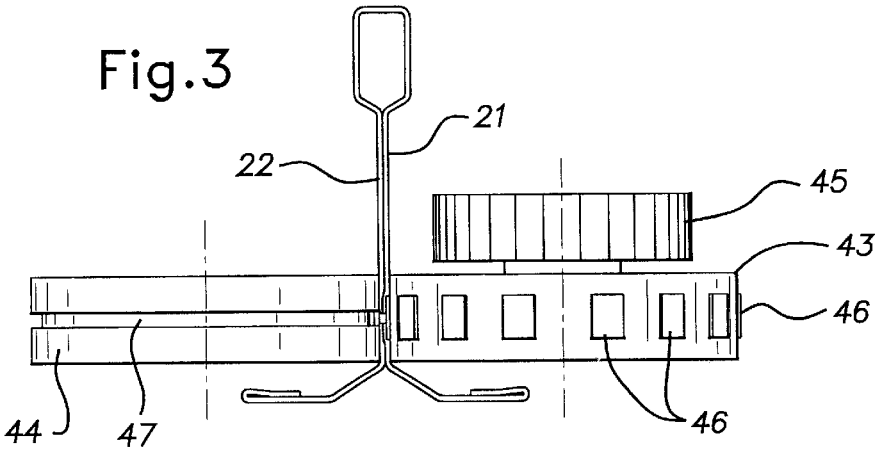
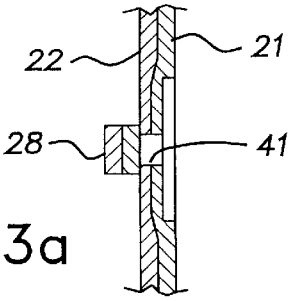
Fig.3a
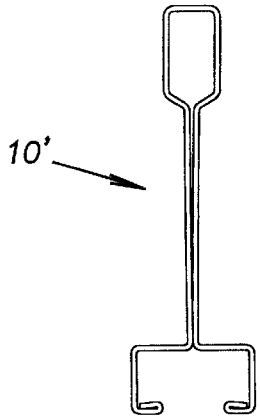
Fig.5
Fig.4
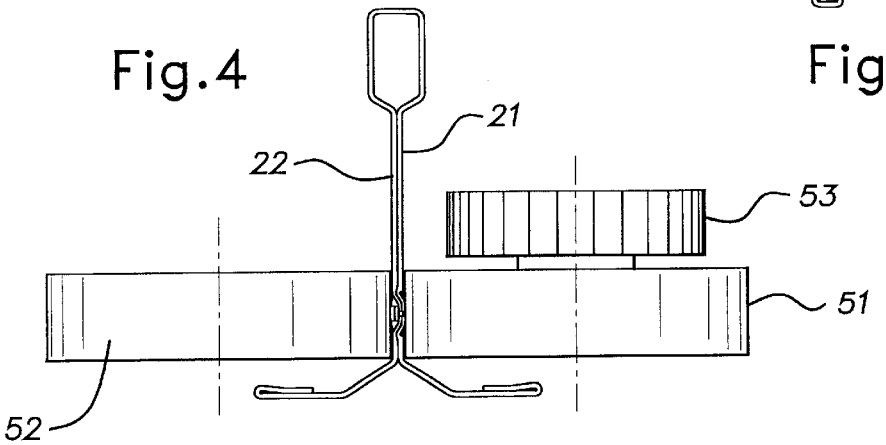
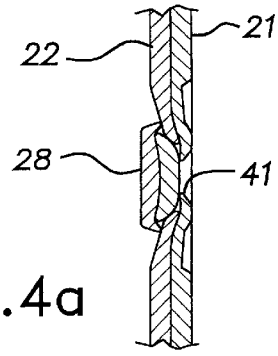
Fig.4a
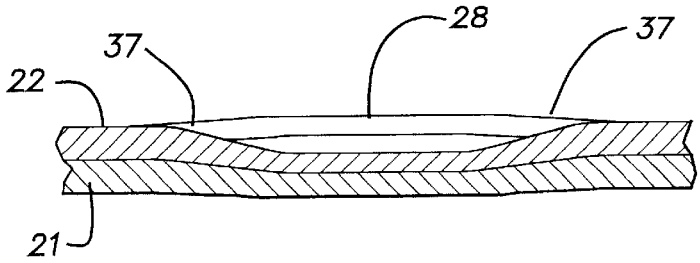
Fig.4b

GRID TEE WITH INTEGRALLY STITCHED WEB

This application is a divisional of Ser. No. 09/034,497 filed Mar. 4, 1998, U.S. Pat. No. 6,047,511.

BACKGROUND OF THE INVENTION

A common grid tee construction comprises a metal strip formed into an upper bulb, a vertically extending double web and oppositely extending lower flanges. It is important for good appearance when there is no cap bridging the flanges and concealing the web elements that the spacing between these elements be uniform along the length of the web. This can be accomplished by fastening the web elements together adjacent the flanges. U.S. Pat. No. 4,489,529 to Ollinger proposes several ways to join the elements of the double web. One such proposal in this patent is to form stitches by lancing the double web elements at locations spaced along the length of the tee. A problem associated with this teaching is that the effective thickness of the web at the stitch locations is doubled. The resulting thickness variation makes it difficult to accurately hold the tee for subsequent forming and/or assembly operations during manufacture. Still further, variable thickness can present difficulties for the installer where the stitch exists or otherwise interferes at a cross tee slot.

Locating the stitches so that they do not interfere with critical parts of the tee is difficult and/or expensive where they are formed in a high speed rolling operation.

It is known to lance or stitch the double web elements in a manner where the material surrounding the lanced hole is coined to reduce the size of the hole after the lance is made to positively interlock the web elements together.

SUMMARY OF THE INVENTION

The invention provides a grid tee of the double web type in which the web elements are locked together by an integral stitch with a configuration that avoids an excessive increase in the local web thickness. The stitch is formed by lancing or shearing through the double thickness of the web to displace a slug out of the plane of the web and create a corresponding hole. The web material is coined or otherwise deformed so that the slug is unable to pass back through the hole. The material forming the slug is forced back into the hole area so that the final thickness of the web in the area of the stitch is not substantially greater than the original web thickness.

In the preferred form of the invention, the web is stitched by three stages of rolling dies that first lance the stitch slug out of the plane of the web. Thereafter, the material surrounding the stitch hole is coined to decrease the size of the hole and thereby prevent the slug from passing back through it. The slug is then rolled to substantially flatten it back into the space of the hole and coined area. Since the stitch, when completed, does not substantially increase the local thickness of the web, it does not interfere with normal manufacturing operations such as where the tee is held in a fixture for hole stamping or other finishing steps such as the assembly of an end clip. Moreover, the stitch pattern, which can have a uniform spacing between stitches even though randomly located along the length of a grid, does not interfere with the reception of transverse tee connectors in slots that happen to fall on the area of a stitch.

BRIEF DESCRIPTION OF THE DRAWINGS

FIG. 3 is a somewhat schematic view of a second stage of apparatus for roll forming stitches wherein the stitch area is coined;

FIG. 3*a* is a fragmentary, sectional view of the coining stage of the stitch formation corresponding to the plane 4*a*—4*a* indicated in FIG. 1;

FIG. 4 is a somewhat schematic view of a third stage of apparatus for roll forming stitches, wherein the stitch area is flattened by compression rolls;

FIG. 4*a* is a fragmentary, sectional view of the third stage of the stitch formation taken in the plane 4*a*—4*a* of FIG. 1;

FIG. 4*b* is a fragmentary, sectional view of a third stage of the stitch formation taken in the plane 4*b*—4*b* indicated in FIG. 1; and FIG. 5 is an example of another style of grid tee for which the invention has application.

DESCRIPTION OF THE PREFERRED EMBODIMENT

Figure 1:
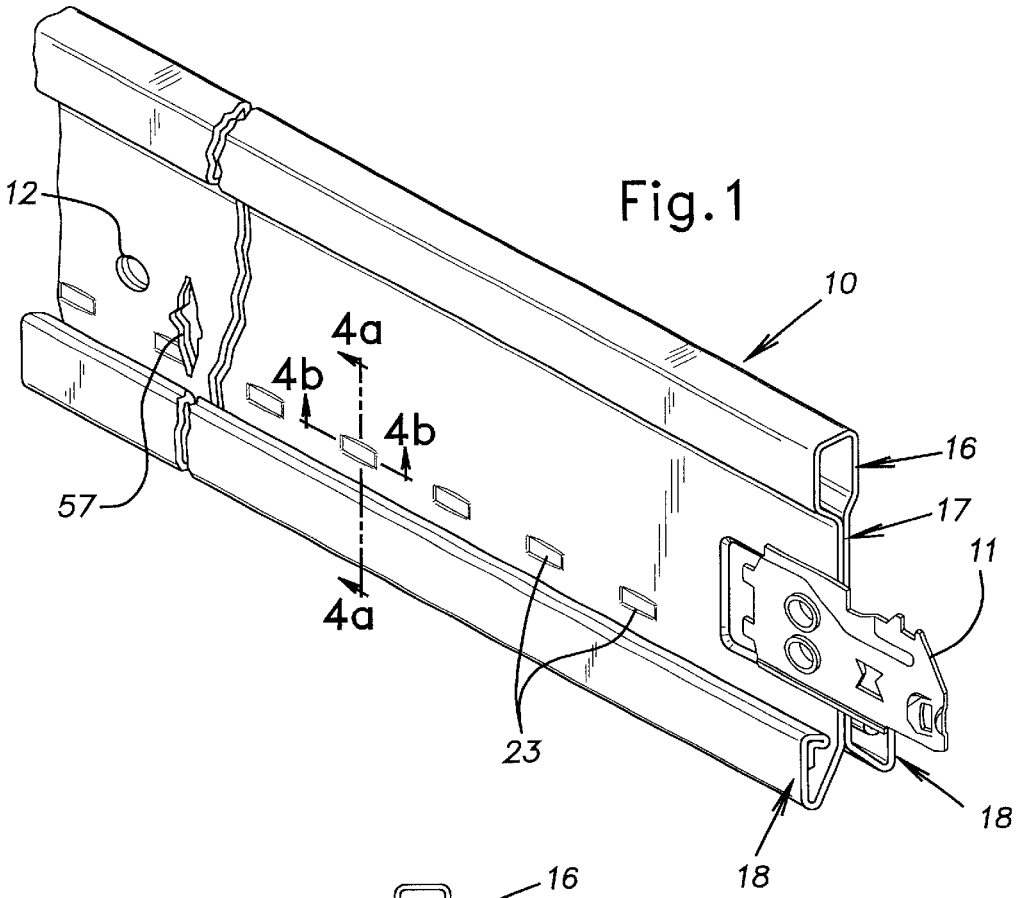
FIG. 1 is a perspective fragmentary view of a tee for a suspended ceiling grid.

The invention is embodied in a grid tee or runner 10 and, as will be understood by those skilled in the art, can be embodied in a main tee or main runner as well as a cross tee or cross runner. The tee 10 is formed of a single metal strip bent, preferably by roll forming techniques known in the art, into the desired cross-sectional configuration. The metal of the tee 10 can be steel, which is suitably painted, coated, or otherwise protected against corrosion. At each end of the tee 10, a connector clip 11 is permanently attached in a known manner such as with a rivet-like formation extruded from the body of the tee 10. Alternatively, the connector clip 11 can be formed as an integral part of the tee 10. Holes 12 punched through the body of the tee are used for suspending the tee with wires or the like from the superstructure of a building.

The sheet stock forming the tee 10 is bent or folded in a known manner along lines parallel to its longitudinal direction to produce an upper bulb 16, a double web 17, and lower flanges 18, all integral with one another. The double web 17 is comprised of two generally flat vertical elements 21, 22. Each of the flanges 18 extends from an associated one of the web elements 21 or 22.

Figure 2:
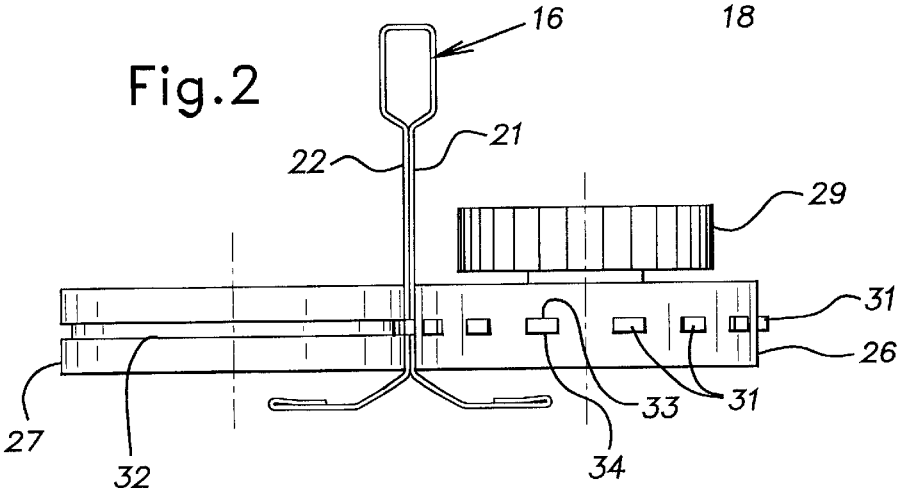
FIG. 2 is a somewhat schematic view of a first stage of apparatus for roll forming stitches in the tee of FIG. 1 wherein the web is lanced to form a displaced stitch slug.

The web elements 21, 22 are mechanically locked together by stitches 23 formed out of the web elements themselves. Ideally, the stitches 23 are situated at uniformly spaced locations along the full length of the tee 10 adjacent the lower edge of the web elements 21, 22. FIGS. 2 through 4 illustrate details of a preferred method and apparatus for stitching the web elements 21, 22 together. At a first station shown in FIG. 2, the tee in an unfinished configuration is passed between a pair of opposed rolls 26, 27. The rolls 26, 27 are suitably mounted for rotation about their respective axes which are parallel to one another and the plane of the web 17. The rolls 26, 27 cooperate to lance a slug 28 of material out of the plane of the web elements 21, 22. One of the rolls 26, which can be power driven through a timing belt pulley 29, has a series of projecting punches 31 spaced uniformly along its circumference. The other roll, 27, which can be friction or power driven, has a continuous peripheral slot 32. Edges 33, 34 of each of the punches 31 and slot 32, respectively, lie in planes perpendicular to the axis of the respective roll 26, 27 and are sharp cutting edges capable of cooperating to shear a slug 28 from the web 17 as the tee 10 passes between the rolls.

The slug 28 is formed with edges 36, that are cut free of the main part of the web 17 and are parallel to the longitudinal axis of the tee 10. Longitudinal ends 37 of the slug 28, as shown in FIG. 4*a*, taken in a plane corresponding to the plane 4*a*—4*a* in FIG. 1 remain attached to the main part of the web 17. As seen from FIG. 2*a*, the slug 28 at this first forming stage has a center part which is completely displaced from the plane of the web 17. This slug formation leaves a corresponding hole 41 in the web 17.

FIG. 3 depicts a second stitch forming station encountered by the tee 10 as the tee is advanced through successive stitch forming stations. A pair of opposed rolls 43, 44 are suitably rotationally mounted at this station with their axes in parallel relation to each other and the previously described rolls 26, 27. One of the rolls 43 is power driven through a timing belt pulley 45 in synchronization with the roll 26. A series of projecting tools 46 are formed on the periphery of the roll 43 with a circumferential spacing equal to the circumferential spacing of the punches 31 on the roll 26. The opposed roll 44 has a circumferential slot 47 that has a width which fits the height of the slugs 28, i.e. the distance between the slug edges 36. The projecting tools or hammers 46 are angularly aligned so that they register on the web area surrounding the holes 41 being formed by displacement of the slugs 28.

As the roll 43 rotates, a projecting tool 46 coins the web area surrounding a hole 41 while the other roll 44 serves as an anvil to support these areas and the slug 28. FIG. 3*a* illustrates the web 17 and area of the slug 28 after the web is struck or coined by a tool projection 46. With the slug 28 rendered larger than the hole 41, as shown, by virtue of the hole being constricted by the coining process, the slug forms a permanent "stitch" that prevents separation of the web elements 21, 22 from each other in areas adjacent the stitch.

At the next stitch forming station represented in FIG. 4, the tee 10 passes between a pair of opposed rolls 51, 52. The rolls 51, 52 are suitably mounted for rotation about vertical axes parallel to the axes of the other rolls 26, 27 and 43, 44. The rolls 51, 52 have substantially cylindrical peripheral surfaces and are located so that they compress the slug 28 back towards the plane of the web as indicated in FIG. 4*a*. At least one of the rolls 51 can be power driven for rotation through a timing belt pulley 53.

Figure 2A:
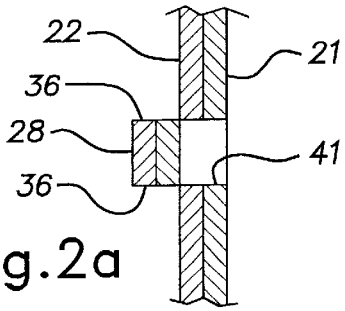
FIG. 2*a* is a fragmentary, sectional view of the first stage of a stitch formation corresponding to the plane 4*a*—4*a* indicated in FIG. 1.

At the first stitch forming stage depicted in FIGS. 2 and 2*a*, the thickness of the web 17 at the stitch is at least about twice the thickness of the non-stitched areas of the web which is twice the thickness of the sheet stock forming the tee 10. The stitch is flattened at the third stage, depicted in FIGS. 4 and 4*a*, to reduce the thickness at this zone as much as is practical. The degree to which the slug 28 is flattened back into the plane of the web 17 can depend, in part, on the original thickness of the web 17. The following table, given by way of example, shows the approximate finished flattened thickness of the web at a stitch for various gauge thicknesses where the tee is made of steel.

| MATERIAL THICKNESS (in.) | FLATTENED STITCH THICKNESS (in.) |
|---|---|
| .015/.017 prepainted steel | .042 |
| .013/.015 prepainted steel | .034 |
| .010/.013 prepainted steel | .026 |

The web 17 will have a nominal thickness apart from the stitch equal to twice the gauge or thickness of the sheet stock material. In the heavier sheet stock material, the stitch is flattened to where the thickness of the web is not more than about ⅓ thicker than the thickness of the web apart from the stitch. It will be seen from FIG. 4*a*, a large part of the slug 28 is driven back into the zone from which it is cut, both into the flattened or coined area and into the remaining part of the hole 41.

After passing through the stitch flattening rolls 51, 52, the illustrated tee 10 is subjected to additional roll forming operations, known in the art, to achieve the cross-sectional configuration shown in FIG. 1. In the subsequent roll forming operations or in supplementary roll forming operations, any curl imparted to the tee by the disclosed stitch forming operations can be worked out by techniques known in the art.

The disclosed stitches 23 are relatively closely spaced to one another and are formed along a line running the full length of the tee 10. The stitches are particularly useful in tee configurations where in the finished installation the areas of the sheet that are bent at the transition between the double web and the diverging flanges are visible. The stitches resist unsightly separation of the web elements 21, 22 and flanges 18 at this transition zone. The separation can occur in conventional tee constructions where the stitches are not provided particularly at the end of a tee that is field cut to length. Field cutting results in local distortion at the cut edges and, without the stitches, the distortion is visually exaggerated by a gap that appears between the web and flange elements.

The disclosed roll forming process for the stitches is particularly suited for the disclosed tee construction employing a series of relatively closely spaced stitches. Since, according to the invention, the stitches after being formed and locked are flattened, they can be located anywhere along a tee without regard, for example, to the location of the end of the tee where the connector 11 is joined or to the location of a cross hole 57 where a connector is received. The minimal increase in thickness to the web produced by the flattened stitch will have essentially no adverse effect on the factory joining of the end connector 11 or the field reception of a connector during erection of a grid where a stitch happens to be located in these areas. The roll formed stitching process is less expensive where it can be performed without precisely locating the stitches in the longitudinal direction.

FIG. 5 illustrates another example of a grid tee 10' with a cross section where the invention is particularly useful. The invention is also useful with double web tees made with a face cap known in the art.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A method of making a grid tee for a suspended ceiling comprising forming an elongated tee by roll forming a strip of metal into a desired cross sectional configuration including a generally planar double web of two layered elements of the strip and diverging flanges each joined to a lower edge of an associated one of the web elements, the web elements being locked together by a pattern of integral stitches running the length of the tee, the stitches being formed by successive rotary tools that first lance a slug out of both elements of the web and leaves a hole at a location from which the material of the lance is displaced, the rotary tools subsequent to the lancing step coining the material of the tee to make the hole of the stitch smaller than the slug to thereby prevent the slug from freely passing back through the hole, the rotary tools subsequent to the coining step substantially flattening the stitch by permanently compressing the slug back into the plane of the web and permanently into a major portion of the hole to a degree where the final thickness of the web at the stitch is not substantially greater than about ⅓ more than the thickness of the web at areas away from the stitch wherein said rotary tools rotate about substantially parallel axes and said axes lie in planes generally perpendicular to the longitudinal direction of the tee and parallel to the plane of the web.

2. A method as set forth in claim 1, wherein the hole of the stitch is made smaller than the slug by coining the material of the web elements at the hole to constrict the hole.

* * * * *